US009714806B2

(12) United States Patent
Gaubert et al.

(10) Patent No.: US 9,714,806 B2
(45) Date of Patent: Jul. 25, 2017

(54) APPARATUS FOR ENHANCED COUNTERBALANCING OF WEAPON MOUNT

(71) Applicant: Raytheon Company, Waltham, MA (US)

(72) Inventors: Zachary M. Gaubert, Dallas, TX (US); John R. Staley, III, Dallas, TX (US); Jerry D. Short, Plano, TX (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 14/895,906

(22) PCT Filed: May 28, 2014

(86) PCT No.: PCT/US2014/039714
§ 371 (c)(1),
(2) Date: Dec. 3, 2015

(87) PCT Pub. No.: WO2014/197249
PCT Pub. Date: Dec. 11, 2014

(65) Prior Publication Data

US 2016/0123691 A1 May 5, 2016

Related U.S. Application Data

(60) Provisional application No. 61/831,057, filed on Jun. 4, 2013.

(51) Int. Cl.
*F41A 27/30* (2006.01)

(52) U.S. Cl.
CPC ..... *F41A 27/30* (2013.01)

(58) Field of Classification Search
CPC ..... F41A 27/30; F41A 27/00; F41A 27/06; F41A 23/02

(Continued)

(56) References Cited

U.S. PATENT DOCUMENTS 1,598,004 A * 8/1926 Paulus ..... F41A 27/06 89/37.16
2,228,179 A * 1/1941 Motley ..... F41A 27/06 89/37.03

(Continued)

FOREIGN PATENT DOCUMENTS

| | | | |
|---|---|---|---|
| CH | 152283 | A | 1/1932 |
| EP | 0 493 762 | A2 | 7/1992 |
| FR | 730707 | A | 8/1932 |

OTHER PUBLICATIONS

International Search Report dated Aug. 28, 2014 in connection with International Patent Application No. PCT/US2014/039714; 3 pages.

(Continued)

*Primary Examiner* — John D Cooper

(57) ABSTRACT

An apparatus (112) includes a housing (104) configured to couple the apparatus to a weapon mount (110) and to secure one or more gas springs (102). The one or more gas springs are configured to provide one or more forces. The apparatus also includes one or more wire ropes (114), where each wire rope is fixed at a first end to the weapon mount and has a hook at a second end. The apparatus further includes one or more guides (108) configured to guide the one or more wire ropes. In addition, the apparatus includes one or more bearings (106) configured to facilitate movement of the one or more wire ropes. The one or more wire ropes are configured to couple movement of the one or more gas springs to a tensile force on a front portion of the weapon mount or a weapon (116) so as to counter-balance a weight of the weapon in the weapon mount.

21 Claims, 3 Drawing Sheets

(58) Field of Classification Search
USPC ..... 89/37.08, 37.09
See application file for complete search history.

(56) References Cited

U.S. PATENT DOCUMENTS

| | | | | | |
|---|---|---|---|---|---|
| 2,960,010 | A * | 11/1960 | Aldrin | F41A 27/30 | 89/37.08 |
| 3,033,085 | A * | 5/1962 | Witkin | F15B 21/00 | 89/37.08 |
| 3,078,766 | A * | 2/1963 | Gannett | F41A 27/30 | 89/37.08 |
| 4,501,190 | A * | 2/1985 | Hobson | F41A 27/24 | 74/440 |
| 4,809,585 | A * | 3/1989 | Wing | F41A 27/30 | 89/37.07 |
| 5,014,595 | A * | 5/1991 | Ducolon, Jr. | F41A 25/10 | 89/178 |
| 5,196,642 | A * | 3/1993 | Tripp | F41A 27/30 | 89/37.08 |
| 5,663,521 | A * | 9/1997 | Mandereau | F41A 27/30 | 89/37.08 |
| 2011/0126699 | A1* | 6/2011 | Briola | F41A 23/34 | 89/37.03 |

OTHER PUBLICATIONS

Written Opinion of the International Searching Authority Aug. 28, 2014 in connection with International Patent Application No. PCT/US2014/039714; 6 pages.

* cited by examiner

APPARATUS FOR ENHANCED COUNTERBALANCING OF WEAPON MOUNT

CROSS-REFERENCE TO RELATED APPLICATIONS AND CLAIM OF PRIORITY

This application claims priority under 35 U.S.C. §365 to International Patent Application No. PCT/US2014/039714 filed on May 28, 2014 and entitled "APPARATUS FOR ENHANCED COUNTERBALANCING OF WEAPON MOUNT" and, through International Patent Application No. PCT/US2014/039714, to U.S. Provisional Patent Application No. 61/831,057 filed on Jun. 4, 2013. Each of these applications is hereby incorporated by reference in its entirety.

TECHNICAL FIELD

The present disclosure is directed in general to weapon system design and more specifically to weapon mounts.

BACKGROUND OF THE DISCLOSURE

A weapon mount is used to pivot, balance, hold, move and target a supported weapon system. Such a weapon mount helps a user in the handling of the weapon system and makes it easier and quicker for the user to aim and fire at objects that may be stationary or moving. A weapon mount typically provides the ability to swing the weapon system easily in the horizontal plane, as well as move the weapon system up or down easily and quickly. A weapon mount may also provide a mechanism to lock the weapon system in place, restricting one or more of the degrees of freedom.

Weapon systems are usually back heavy. The weight of a weapon system depends on a variety of parameters, such as how many ammunitions are loaded, how many are left unused, and the type and number of accessories that are mounted on the weapon system. The basic weight of a weapon system varies from weapon system to weapon system. Most weapon mounts are designed to support a few selected weapon systems, usually in the same family of weapons. Because of the dynamic variations in weight and spatial distributions of weight during operation, weapon mounts have struggled to adopt dynamically to provide the best user interface. In addition, time is of the essence during tactical usage of the weapons systems, and ease of use plays a critical role in the use of the weapon systems.

SUMMARY OF THE DISCLOSURE

Various embodiments are disclosed that substantially enhance a user interface of a weapon system. For example, one or more embodiments make the retargeting of a weapon system quick and easy.

In a first embodiment, a mounting apparatus includes a housing configured to couple the mounting apparatus to a weapon mount and to secure one or more gas springs, where the one or more gas springs are configured to provide one or more forces. The mounting apparatus also includes one or more wire ropes associated with the one or more gas springs, where each wire rope is fixed at a first end to the weapon mount and has a hook at a second end. The mounting apparatus further includes one or more guides within the housing, where the one or more guides are configured to guide the one or more wire ropes. In addition, the mounting apparatus includes one or more bearings configured to facilitate movement of the one or more wire ropes. The one or more wire ropes are routed through the one or more guides using the one or more bearings, and the hook at the second end of each wire rope is attached to a front portion of the weapon mount or a weapon in the weapon mount. The one or more wire ropes are configured to couple movement of the one or more gas springs to a tensile force on the front portion of the weapon mount or the weapon so as to counter-balance a weight of the weapon in the weapon mount.

In particular embodiments, one or more adjustable knobs are configured to adjust the one or more forces from the one or more gas springs to offset for additional weight due to, for example, accessories or varying loads of loaded ammunition. Also, in particular embodiments, the mounting apparatus includes one or more locking mechanisms configured to restrict movement of the weapon or the weapon mount in one or more degrees of freedom.

In a second embodiment, a method includes mounting a housing on a weapon mount and mounting one or more gas springs on the housing. The method also includes attaching a first end of each of one or more wire ropes to a fixed portion of the weapon mount and routing the one or more wire ropes through one or more guides using one or more bearings in the housing. The method further includes attaching a second end of each of the one or more wire ropes to one or more front portions of the weapon mount or a weapon in the weapon mount. The one or more wire ropes are configured to translate one or more forces from the one or more springs into one or more tensile forces to counter-balance a weight of the weapon.

In a third embodiment, a weapon system counter-balance apparatus includes one or more gas springs configured to be mounted on a weapon mount or a weapon in the weapon mount, where the one or more gas springs are configured to provide one or more forces. The weapon system counter-balance apparatus also includes one or more translation mechanisms configured to direct the one or more forces from the one or more gas springs to counter-balance the weapon.

Other technical features may become readily apparent to one of ordinary skill in the art after review of the following figures and description.

BRIEF DESCRIPTION OF THE DRAWINGS

For a more complete understanding of the present disclosure and its advantages, reference is now made to the following description, taken in conjunction with the accompanying drawings, in which like reference numerals represent like parts.

DETAILED DESCRIPTION

Figure 1:
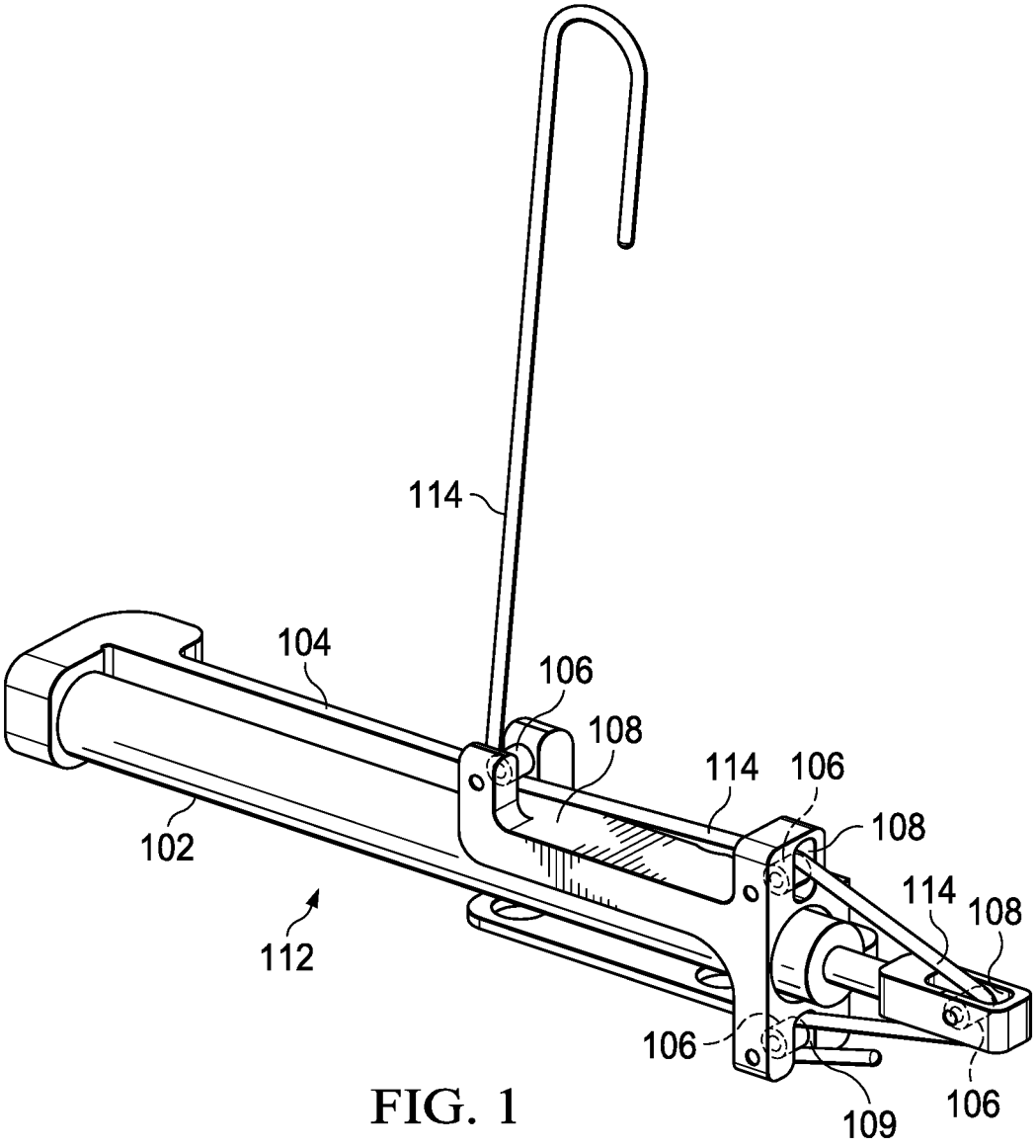
FIG. 1 shows a mounting apparatus according to an embodiment of the disclosure.
Figure 2:
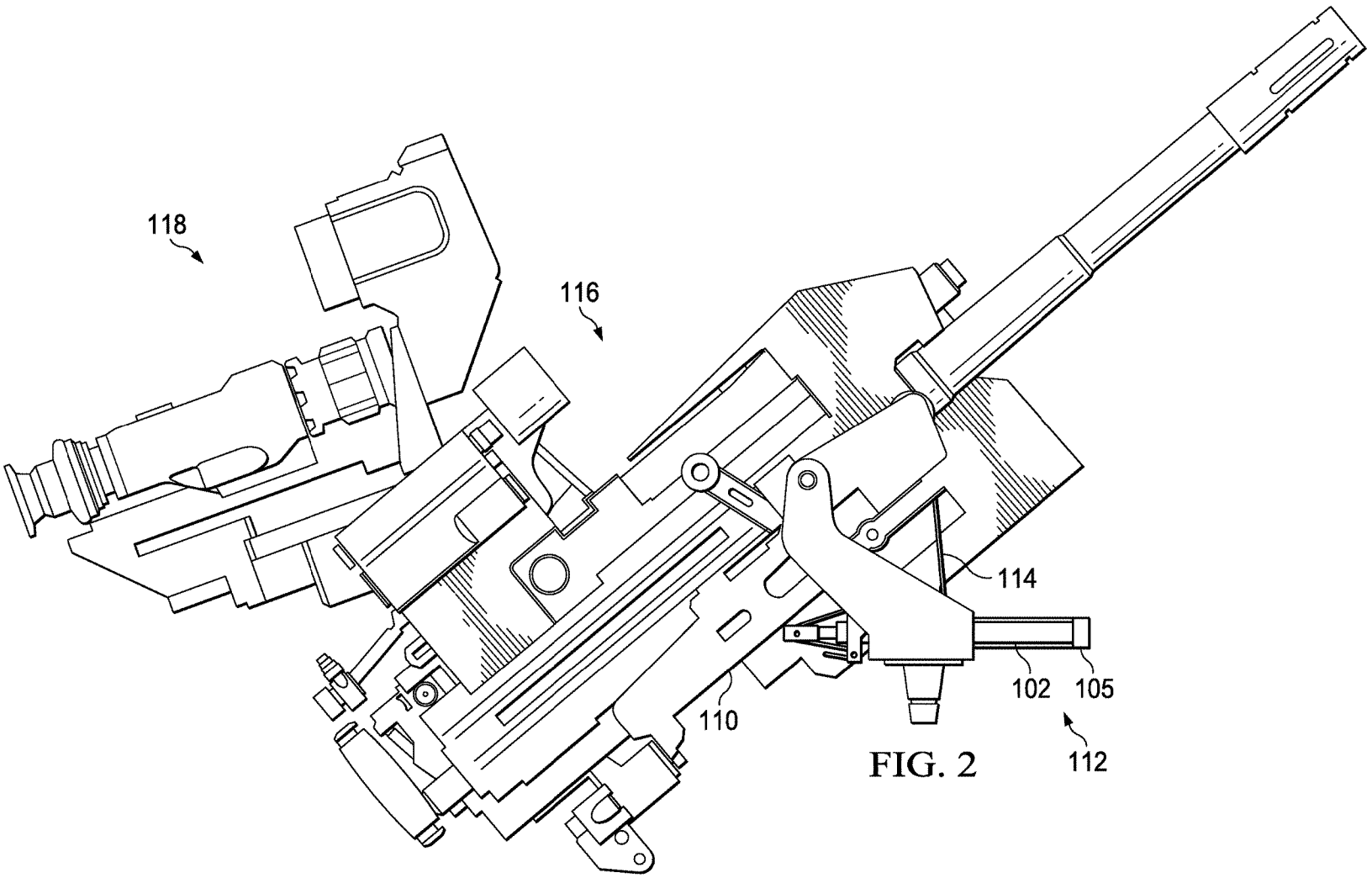
FIGS. 2 and 3 show the mounting apparatus of FIG. 1 mounted on an MK93 weapon mount according to an embodiment of the disclosure.
Figure 3:
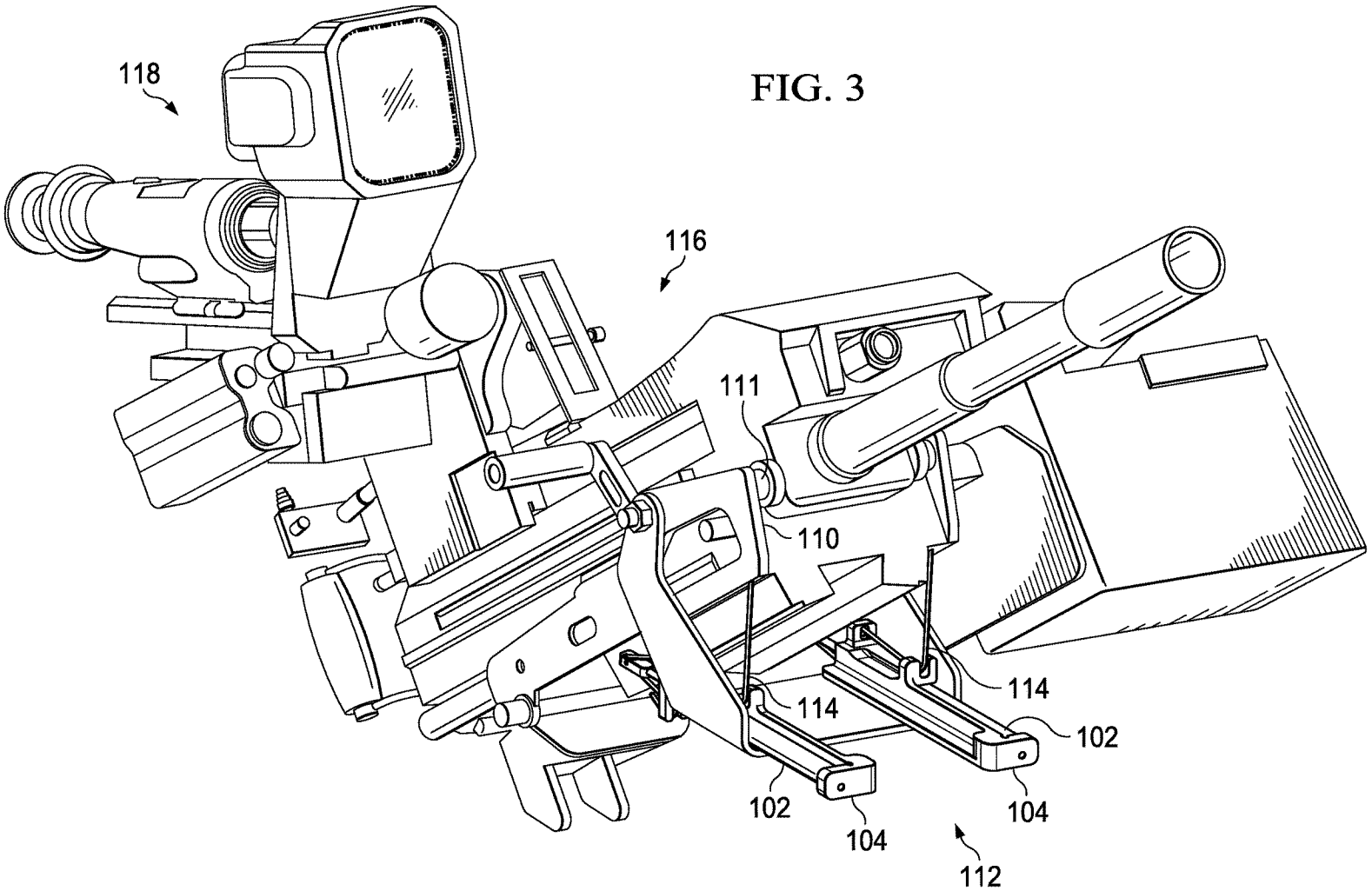

The discussion below with reference to FIGS. 1 through 3 is by way of illustration only and should not be construed in any way to limit the scope of the disclosure. Those skilled in the art will understand that the principles of the present invention may be implemented in any type of suitably arranged device or system. It should be understood that, although example embodiments are described below, the present invention may be implemented using any number of techniques, whether currently known or not. The present invention should in no way be limited to the example implementations, drawings, and techniques described below. Additionally, the drawings are not necessarily drawn to scale.

The user interface problems identified above (due to dynamically varying weight and uneven distribution of weight around a primary pivot in a weapon mount) continue to affect the effectiveness of weapon systems today. Conventional attempts at solving this problem use mechanical adjustment mechanisms, such as screws and slides commonly referred to as traversing and elevation mechanisms. However, these mechanisms often require manual manipulation for targeting and are relatively slow and cumbersome to use. Additionally, such mechanisms can inhibit rotational freedom of a weapon system.

Some of the specific problems with available approaches include the following:

- A user requires significant exertion to hold a weapon system in place.
- The user has to take his or her hand off of the weapon system and dedicate the hand to move the weapon system up or down.
- Once the user takes his or her hand off of the weapon system, the weapon system does not stay in place due to its weight and the weight of ammunition.
- Conventional screws and slides mechanisms are slow and cumbersome. This lack of ease of use, agility and slow speed adds time to retarget the weapon system.

Accordingly, certain embodiments are presented to overcome one, some, or all of these deficiencies. As shown in the figures and described below, embodiments of the present disclosure provide a counter-balancing design that is a bolt-on assembly to, for example, an MK93 mount or other weapon mount. Although embodiments will be described with reference to an MK93 mount, embodiments of the disclosure may be utilized with other configurations. More particularly, the embodiments in this disclosure are adaptable to many weapon mounts and many weapon systems.

According to certain embodiments, the design uses one or more gas springs to provide a tensile force through one or more wire ropes, which are attached to the pivoting portion of a weapon mount and to a gas spring housing. The housing has one or more integral wire guides and bearings to control the motion of the wire rope(s) during travel of the gas spring(s) as the weapon system is moved. Friction within the mount holds the position of the weapon system once it is released by a user.

According to particular embodiments, such a configuration provides an efficient method of freely targeting with either an MK19 or M2 weapon system as used in conjunction with an MK93 weapon mount. Additionally, according to particular embodiments, the solution can be tailored to account for variable weapon accessories or configurations and does not require modifications to standard hardware.

FIG. 1 shows a mounting apparatus 112 according to an embodiment of the disclosure. The mounting apparatus 112 includes one or more gas springs 102 (also referred to as gas spring cylinders) mounted within a housing 104. The housing 104 contains integral bearings 106 and mounting points or pulleys 108 for a wire rope 114. The wire rope 114 attaches to the housing 104 and to the rotating portion of an MK93 mount or other weapon mount 110 (shown in FIGS. 2 and 3). A mounting point 109 is the fixed end of the wire rope 114. The wire rope 114 can be made of any suitable material, such as steel, stranded aluminum, a combination of alloys, polyurethane, Kevlar, or other like materials.

A particular configuration may contain a steel wire (stranded or solid) with a thickness in the range from 0.090 inches to 0.125 inches in diameter (inclusive) with a gas spring that asserts a force in the range of 50 lbs to 130 lbs (inclusive). Due to the pulley effect of the design shown in FIG. 1, the tensile force exerted by the wire rope 114 will be approximately twice the force exerted by the gas spring 102 on the wire rope 114. Additional pulley mechanisms can be added to change the net tensile force.

Note that any suitable tensile force can be provided by the mounting apparatus 112. For example, the tensile force could counter-balance the weight of the weapon in the weapon mount to within a margin of ±10% of the weight.

FIGS. 2 and 3 show the mounting apparatus 112 of FIG. 1 mounted on an MK93 weapon mount 110 according to an embodiment of the disclosure. As shown here, the mounting apparatus 112 includes one or more knobs 105 that are used to adjust the tensile force on the wire rope 114 applied by the gas spring 102.

The mounting apparatus 112 here uses two unused mounting holes to mount onto the MK93 weapon mount 110, thus fitting into place using the available spacing of the existing MK93 weapon mount 110 without any modifications. The MK93 weapon mount 110 has a front pivot and a back primary pivot. The front pivot is located away from the center of gravity and towards the front barrel of a weapon system 116. A hook in the top part of the wire rope 114 hooks close to the front pivot at a convenient location 111, thereby allowing a counter-force and torque to balance the gravitational force and torque created by the weight of the weapon system 116. In other weapon mounts, the top hook of the wire rope 114 can be mounted onto a bolt or any other portion of the front of the weapon system, such as a front pivot, to generate this counter-balancing effect in order to offset the force and torque generated by the weight of the weapon mount 110.

Without the mounting apparatus 112, the weapon mount 110 is usually in a default position of the front barrel pointing upwards and the heavy back pulled downwards. With the mounting apparatus 112 mounted on the weapon mount 110, the default position could often be at the horizontal level as the gas spring 102 and the wire rope 114 assert the counter-balancing tensile force and torque to offset the weight of the weapon system 116. When a user of the weapon system 116 takes his or her hands off the weapon system 116 or swings it laterally or moves it up or down, the weapon system 116 can typically stay substantially in place due to inherent friction in the weapon mount 110 and bearings and the mounting apparatus 112 providing the counter-balance to keep the weapon system 116 in place. As ammunitions get used by or accessories get added to the weapon system 116, the tensile force asserted by the gas spring and wire assembly is usually adequate to still keep the weapon system 116 in place due to inherent frictions at the pivots and bearings, and the counter-balancing tensile force can be quickly adjusted if needed by the adjusting the knob(s) 105 of the gas spring as described earlier.

Different weapon mounts and different weapon systems may require one or more wire hooks, one or more gas springs, or different levels of tensile forces. The number and type of wire rope (such as material, type (solid or stranded), and thickness), the number and type of gas springs, and the number of wire hooks can all be chosen to fit the need of any target weapon mount and weapon system.

In the particular embodiment shown in FIG. 3, two sets of gas springs 102 and wire ropes 114 are shown. However, only one set may be utilized in certain configurations.

Additionally, more than two sets may be utilized in other configurations. Moreover, the gas springs 102 create a tensile load on the wire ropes 114, which in turn provide a relatively consistent downward tensile force that counterbalances the weapon system 116 as well as any additional accessories 118. Although gas springs 102 are shown in this configuration, other mechanisms capable of creating a tensile load may be used in other configurations. For instance, the gas springs 102 can be replaced with other types of springs or devices that can assert a similar tensile force on wire ropes 114, such as variable-force springs, different springs with preset-forces, or other non-spring devices.

The force of a gas spring 102 can be altered based on the weapon system or accessories being used or based on user preferences. When properly balanced, the inherent friction within the mount 110 stabilizes the weapon system 116 to hold it in position when the user releases the hold, thereby allowing for optimal operational effectiveness. Additionally, according to certain embodiments, the design provides unrestricted rotation with little or no force, still keeping the balanced weapon system 116 in the same positions in other dimensions. Such a stable freedom of motion can become critical to operational effectiveness of the targeting solution.

The actual mounting locations of the gas springs 102 or the actual routings of the wire ropes 114 can be varied based on the weapon mount, weapon systems, and accessories mounted on the weapon systems. For example, there can be additional bearings 106 depending on the routing of the wire rope 114, and there can be additional mounting points or pulleys 108 to add additional turns or additional load bearing capacities. There can also be additional fixed ends (with mounting points 109) or additional knobs 105 to provide for the necessary tensile and torques forces to fit the target systems for the intended purposes described here.

As seen in FIGS. 1 through 3, the mounting apparatus 112 has a low profile to fit in place inside the spacing of the MK93 mount 110 without modification (as seen, for example, in FIG. 3). The profile height, width and length can be made as low as needed to fit in the available space of a weapon mount or a weapon system.

Certain embodiments of this disclosure can be configured to set the weapon system 116 to be pushed down (overcorrected) as opposed to being pulled up based on user preferences. The "pushed down" configuration allows the user to use the user's body weight to the user's advantage, as opposed to relying on the user's arm strength for targeting. This can reduce fatigue on the user and prolong operational effectiveness.

Nothing in this disclosure precludes the combined use of an embodiment having one or more inventive features with traditional techniques, such as traditional haversing and elevation mechanisms and locking mechanisms. The embodiment in FIG. 1 supports such use. For example, an embodiment disclosed here can be used with a traditional locking mechanism to restrict one or more degrees of freedom.

While this disclosure has described certain embodiments and generally associated methods, alterations and permutations of these embodiments and methods will be apparent to those skilled in the art. For example, although particular mounts and weapons have been described, other mounts and weapons may avail from teachings of the disclosure. Accordingly, the above description of example embodiments does not define or constrain this disclosure. Other changes, substitutions, and alterations are also possible without departing from the spirit and scope of this disclosure.

It may also be advantageous to set forth definitions of certain words and phrases used throughout this patent document. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. In addition, "each" refers to each member of a set or each member of a subset of a set.

Modifications, additions, or omissions may be made to the systems, apparatuses, and methods described here without departing from the scope of the disclosure. The components of the systems and apparatuses may be integrated or separated. Moreover, the operations of the systems and apparatuses may be performed by more, fewer, or other components. The methods may include more, fewer, or other steps. Additionally, steps may be performed in any suitable order.

To aid the Patent Office, and any readers of any patent issued on this application in interpreting the claims appended hereto, applicants wish to note that they do not intend any of the appended claims or claim elements to invoke paragraph 6 of 35 U.S.C. Section 112 as it exists on the date of filing hereof unless the words "means for" or "step for" are explicitly used in the particular claim.

What is claimed is:

1. A mounting apparatus comprising:

a housing configured to couple the mounting apparatus to a weapon mount and to secure one or more gas springs, the one or more gas springs configured to provide one or more forces, wherein the weapon mount is configured to enable vertical rotation of a weapon in the weapon mount, and wherein the housing is configured to maintain the one or more gas springs in a fixed position relative to the weapon mount and independent of the vertical rotation of the weapon;

one or more wire ropes associated with the one or more gas springs, each wire rope fixed at a first end to the weapon mount and having a hook at a second end;

one or more guides within the housing, the one or more guides configured to guide the one or more wire ropes; and one or more bearings configured to facilitate movement of the one or more wire ropes;

wherein the one or more wire ropes are routed through the one or more guides using the one or more bearings, the hook at the second end of each wire rope attached to a front portion of the weapon mount or the weapon in the weapon mount; and wherein the one or more wire ropes are configured to couple movement of the one or more gas springs to a tensile force on the front portion of the weapon mount or the weapon so as to counter-balance a weight of the weapon in the weapon mount.

2. The mounting apparatus of claim 1, wherein the housing is configured to couple the mounting apparatus to an MK93 weapon mount.

3. The mounting apparatus of claim 1, wherein the mounting apparatus is configured to counter-balance the weight of an MK19 or an M2 in the weapon mount.

4. The mounting apparatus of claim 1, further comprising:

one or more locking mechanisms configured to restrict movement of the weapon or the weapon mount in one or more degrees of freedom.

5. The mounting apparatus of claim 1, further comprising: one or more adjustable knobs configured to adjust the one or more forces from the one or more gas springs.

6. The mounting apparatus of claim 5, wherein the one or more adjustable knobs are configured to adjust the one or more forces to offset weight of at least one of: one or more accessories mounted on the weapon and ammunition loaded in the weapon.

7. The mounting apparatus of claim 1, wherein two gas springs are mounted on the housing.

8. The mounting apparatus of claim 1, wherein each wire rope has a thickness between 0.090 inches and 0.125 inches inclusive.

9. The mounting apparatus of claim 1, wherein each wire rope is one of: solid or stranded.

10. The mounting apparatus of claim 1, wherein each wire rope is made of steel, an alloy of steel, aluminum, an alloy of aluminum, polyurethane, or Kevlar.

11. The mounting apparatus of claim 1, wherein the tensile force exceeds the weight of the weapon.

12. The mounting apparatus of claim 1, wherein the one or more gas springs comprise one or more variable-force springs or springs with preset forces.

13. The mounting apparatus of claim 1, wherein the mounting apparatus does not restrain rotational movement of the weapon mount or the weapon in a horizontal plane.

14. The mounting apparatus of claim 1, wherein the tensile force counter-balances the weight of the weapon in the weapon mount to within a margin of ±10% of the weight of the weapon in the weapon mount.

15. The mounting apparatus of claim 1, wherein at least one of the one or more bearings are configured to act as at least one pulley.

16. The mounting apparatus of claim 1, wherein:

the weapon mount comprises a front pivot and a back primary pivot;

the front pivot is located away from a center of gravity and towards a front barrel of the weapon; and the hook of each wire rope is configured to couple to the front pivot.

17. A method comprising:

mounting a housing on a weapon mount, the weapon mount configured to enable vertical rotation of a weapon in the weapon mount;

mounting one or more gas springs on the housing;

attaching a first end of each of one or more wire ropes to a fixed portion of the weapon mount;

routing the one or more wire ropes through one or more guides using one or more bearings in the housing; and attaching a second end of each of the one or more wire ropes to one or more front portions of the weapon mount or the weapon in the weapon mount;

wherein the one or more wire ropes are configured to translate one or more forces from the one or more gas springs into one or more tensile forces to counter-balance a weight of the weapon, and wherein the housing is configured to maintain the one or more gas springs in a fixed position relative to the weapon mount and independent of the vertical rotation of the weapon.

18. The method of claim 17, further comprising:

locking the weapon in a specified position.

19. The method of claim 17, further comprising:

adjusting the one or more forces from the one or more gas springs.

20. The method of claim 17, wherein each wire rope has a thickness between 0.090 inches and 0.125 inches inclusive.

21. The method of claim 17, wherein each wire rope is made of steel, an alloy of steel, aluminum, an alloy of aluminum, polyurethane, or Kevlar.

* * * * *